US009814125B2

(12) United States Patent
Camara et al.

(10) Patent No.: US 9,814,125 B2
(45) **Date of Patent: *Nov. 7, 2017**

(54) COMPACT X-RAY GENERATION DEVICE

(71) Applicant: Tribogenics, Inc., Los Angeles, CA (US)

(72) Inventors: Carlos G. Camara, Los Angeles, CA (US); Benjamin A. Lucas, Los Angeles, CA (US); Zachary J. Gamlieli, Los Angeles, CA (US)

(73) Assignee: Tribogenics, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/878,795

(22) Filed: Oct. 8, 2015

(65) Prior Publication Data

US 2016/0029469 A1 Jan. 28, 2016

Related U.S. Application Data

(63) Continuation of application No. 13/839,494, filed on Mar. 15, 2013, now Pat. No. 9,173,279.

(51) Int. Cl.

| | |
|---|---|
| ***H01J 35/00*** | (2006.01) |
| ***H05G 2/00*** | (2006.01) |
| ***H01J 35/08*** | (2006.01) |
| ***H01J 35/18*** | (2006.01) |
| ***H01J 35/06*** | (2006.01) |

(52) U.S. Cl.

CPC ..... *H05G 2/00* (2013.01); *H01J 35/06* (2013.01); *H01J 35/08* (2013.01); *H01J 35/18* (2013.01); *H01J 2235/081* (2013.01); *H01J 2235/186* (2013.01)

(58) Field of Classification Search

None

See application file for complete search history.

(56) References Cited

U.S. PATENT DOCUMENTS

| | | | |
|---|---|---|---|
| 2,810,077 | A | 10/1957 | Gale |
| 3,612,918 | A | 10/1971 | Willutzki |
| 3,934,164 | A | 1/1976 | Braun et al. |
| 4,789,802 | A | 12/1988 | Miyake |
| 4,990,813 | A | 2/1991 | Paramo |
| 5,665,969 | A | 9/1997 | Beusch |
| 6,353,658 | B1 | 3/2002 | Trebes et al. |

(Continued)

FOREIGN PATENT DOCUMENTS

| | | | |
|---|---|---|---|
| EP | 0833365 | B1 | 12/2003 |
| JP | H09-045492 | A | 2/1997 |
| JP | 2007-311195 | A | 11/2007 |
| WO | WO 2012-125492 | A2 | 9/2012 |
| WO | WO 2013-032020 | A2 | 3/2013 |

OTHER PUBLICATIONS

Klyuev et al., "The effect of air pressure on the parameters of x-ray emission accompanying adhesive and cohesive breaking solids", Sov. Phys. Tech. Phys., vol. 34, Mar. 1989, pp. 361-364.

(Continued)

*Primary Examiner* — Dani Fox

(74) *Attorney, Agent, or Firm* — Klein, O'Neill & Singh, LLP

(57) ABSTRACT

An x-ray transmitter, which may be compact, may be in the form of a housing with an x-ray transparent window sputtered with a metal on one wall, and tribocharging electron source on another wall.

10 Claims, 8 Drawing Sheets

(56) References Cited

U.S. PATENT DOCUMENTS

| | | | |
|---|---|---|---|
| 6,476,406 | B1 | 11/2002 | Struye et al. |
| 6,493,423 | B1 | 12/2002 | Bisschops |
| 6,668,039 | B2 | 12/2003 | Shepard et al. |
| 6,925,151 | B2 | 8/2005 | Harding et al. |
| 7,060,371 | B2 | 6/2006 | Akiyama et al. |
| 7,596,242 | B2 | 9/2009 | Breed et al. |
| 2003/0021377 | A1 | 1/2003 | Turner et al. |
| 2006/0056595 | A1 | 3/2006 | Sampayon |
| 2007/0110217 | A1 | 5/2007 | Ukita |
| 2009/0050847 | A1 | 2/2009 | Xu et al. |
| 2009/0090828 | A1 | 4/2009 | Junkins |
| 2009/0090875 | A1 | 4/2009 | Gelbart et al. |
| 2009/0238340 | A1 | 9/2009 | Okada et al. |
| 2011/0130613 | A1 | 6/2011 | Putterman et al. |

OTHER PUBLICATIONS

Nakayama et al., "Triboemission of charged particles and photons from solid surfaces during frictional damage", Journal of Physics D. Applied Physics, vol. 25, No. 2, Feb. 14, 1992, pp. 303-308.

Nishitani et al., "STM tip-enhanced photoluminescence from porphyrin film", Surface Science, North-Holland Publishing Co., vol. 601, No. 17, Aug. 23, 2007, pp. 3601-3604.

Ohara et al., "Light emission due to peeling of polymer films from various substrates", Journal of Applied Polymer Science, vol. 14, No. 8, Aug. 1, 1970, pp. 2079-2095.

International Search Report on related PCT Application No. PCT/US2014/027795 from International Searching Authority (KIPO) dated Jul. 11, 2014.

Written Opinion on related PCT Application No. PCT/US2014/027795 from International Searching Authority (KIPO) dated Jul. 11, 2014.

U.S. Appl. No. 13/839,494, filed Sep. 2014, Carlos G. Camara, Benjamin A. Lucas, Zachary J. Gamlieli, US 2014-0270088 A1, Office Action dated Dec. 1, 2014, Notice of Allowance dated Jun. 25, 2015.

Stefan Kneip, "A stroke of X-ray", Nature, vol. 473, May 26, 2011, pp. 455-456.

Office action on related Chinese Patent Application No. 201480020460.9 from State Intellectual Property Office (SIPO) dated Jun. 3, 2016.

Office action on related Russian Patent Application No. 2015143828 from the Patent Office of the Russian Federation dated Mar. 3, 2017.

Camara et al., "Mechanically driven millimeter source of nanosecond X-ray pulses", Applied Physics B, Lasers and Optics, Springer, Berlin, DE, vol. 99, No. 4, May 14, 2010, pp. 613-617.

Extended European Search Report on related European Patent Application No. 14762828.3 from the European Patent Office (EPO) dated Nov. 3, 2016.

Office action on related Japanese Patent Application No. 2016-502627 from the Japan Property Office (JPO) dated Oct. 18, 2016.

COMPACT X-RAY GENERATION DEVICE

CROSS-REFERENCE TO RELATED APPLICATION

The present application is a continuation of U.S. patent application Ser. No. 13/839,494, filed Mar. 15, 2013, the disclosure of which is incorporated by reference herein.

BACKGROUND OF THE INVENTION

The present invention relates generally to generation of x-rays, and more particularly to a tribocharging x-ray transmitter.

X-rays are used in a variety of ways. X-rays may be used for medical or other imaging applications, crystallography related applications including material analysis, or in other applications.

X-rays are generally generated by electron braking (bremmstrahlung) or inner shell electron emission within a material. Historically, other than through natural phenomena, x-rays generally have been generated by accelerating electrons into a material, such as a metal, with a small proportion of the electrons causing x-rays through bremmstrahlung or knocking electrons present in the material out of inner orbitals, for example K-shell orbitals, with x-rays being generated as electrons in higher energy orbitals transition to the lower energy orbitals. Acceleration of the electrons to generate a useful quantity of x-rays, however, generally requires high powered electrical energy sources, which may include bulky equipment.

X-rays may also be generated by changes in mechanical contact between materials in a controlled environment, for example through the unpeeling of pressure sensitive adhesive tape or mechanical contact of some materials in an evacuated chamber. However, changing mechanical contact between materials generally involves moving parts within the evacuated chamber, and generally also requires that some of the moving parts frictionally contact one another. The moving parts and the frictional contact may result in outgassing and production of free debris in the evacuated chamber, possibly impacting operation of such a device.

BRIEF SUMMARY OF THE INVENTION

Aspects of the invention provide an x-ray emitter which may be of a compact design. In some embodiments a small housing, maintaining a low fluid pressure environment therein, has a first wall with a substantially x-ray transparent window with an interior coated with a metal and a second wall with at least a portion of an exterior surface formed of an electrical insulator, preferably a dielectric material. The metal on the window provides an electron target, and alternatively the electron target may instead be positioned within the housing. The portion of the wall may be the dielectric material itself, or the portion of the wall may be a metal, otherwise electrically insulated from the rest of the housing, with a dielectric exterior covering. A contacting material, preferably higher in a triboelectric series, is in changing contact with the exterior covering, with the changing contact preferably being intermittent contact as well. A filament, preferably heatable and preferably metallic, is within the housing, for example proximate the second wall. In operation contact, removal of contact between the contacting material and the dielectric generates a negative electrical charge on the portion of the second wall, particularly an interior surface of the portion of the second wall.

Electrons associated with the negative charge, and/or electrons provided by the filament may travel to and impact the metal on the interior of the substantially x-ray transparent window, generating x-rays which are emitted or transmitted through the window.

Some aspects of the invention provide an x-ray emission device, comprising: a housing configured to maintain a low fluid pressure environment, the housing having a first wall with a window substantially transparent to x-rays and a second wall having a portion comprising an exterior surface comprising an electrically insulating material; an electron target comprised of a metal within the housing; an electrically chargeable material within the housing; and a contact material for frictionally contacting the electrically insulating material, the contact material being lower in a triboelectric series than the electrically insulating material.

Some aspects of the invention provide a method of emitting x-rays from a housing, the housing being substantially opaque to x-rays and having a chamber at a low fluid pressure, comprising: frictionally contacting an exterior surface of the housing with a contacting surface, the exterior surface and the contacting surface being of different materials, whereby a charge imbalance is generated through the frictional contact, with accumulation of negative charge by the exterior surface; allowing for a flow of electrons, from about an interior surface of the housing proximate the exterior surface contacted by the contacting surface, and towards a window of the housing; generating x-rays proximate the window of the housing, the window of the housing being substantially transparent to x-rays.

Some aspects of the invention provide a device for emission of x-rays, comprising: a housing configured to maintain a low fluid pressure in a chamber within the housing, the housing including a window substantially transparent to x-rays but otherwise substantially opaque to x-rays; means for generating a charge imbalance on a portion of the housing through changing contact of material external to the housing with a surface of the housing; an electron target within the housing; and a filament within the housing substantially between the portion of the housing and the electron target.

These and other aspects of the invention are more fully comprehended upon review of this disclosure.

DETAILED DESCRIPTION

Figure 1:
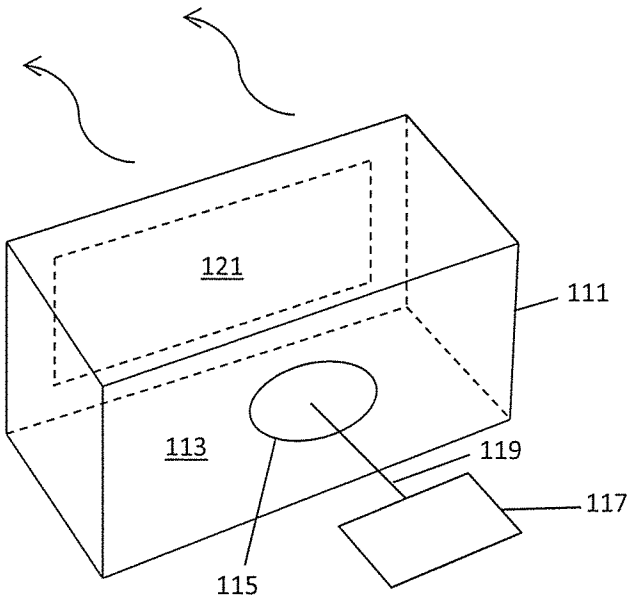
FIG. 1 illustrates aspects of an x-ray emission device in accordance with aspects of the invention.

FIG. 1 illustrates aspects of an x-ray transmission device in accordance with aspects of the invention. The device includes a housing 111, with the housing configured to maintain a low fluid pressure environment. In some embodiments the low fluid pressure environment is an environment with a pressure less than 200 mTorr, in some embodiments a pressure less than 50 mTorr, and in some embodiments a pressure less than 10 mTorr. In some embodiments a gas, such as Argon, is contained in the housing, with the gas serving to assist in control of current flow from oppositely charged surfaces or from a charged surface to ground, and the gas can serve as a source of electrons. Partial pressure of the gas may be, for example, 50 mTorr, and in various embodiments may be between 1 mTorr and 200 mTorr. In some embodiments the housing is generally of a ceramic material.

The housing has a first wall 113 with at least a portion having an electrically insulating exterior surface, a polyimide film, for example Kapton, in some embodiments, and preferably a dielectric material. In some embodiments the portion of the wall having the electrically insulating exterior is a membrane formed of the electrically insulating exterior. In some embodiments the portion of the wall comprises a metal, electrically insulated from other portions of the housing, towards an interior of the housing, with the electrically insulating material covering the metal on the exterior of the housing. In some embodiments the portion of the housing comprises a grid of metals, which may in some embodiments be within, upon or floated on other material. In some embodiments the portion of the wall comprises a non-metal, for example a glass or a ceramic material.

A contacting surface 115 is in changing contact with the electrically insulating exterior of the housing. The contacting surface is preferably of a material such that changing contact between the contacting surface and the electrically insulating material generates a charge imbalance. Preferably, the material is such that the electrically insulating material becomes more negatively charged. In some embodiment the material is higher in a triboelectric series than the electrically insulating material. The contacting surface may be in changing contact with the electrically insulating material by way of frictional contact of the contacting surface over varying surface areas of the electrically insulating material. This may be accomplished, for example, by having different portions of the contacting surface in contact with different portions of the electrically insulating material over time, by way of repetitive contact and separation of the surfaces, or by way of some or all of the foregoing.

The contacting surface may be moved, or driven, in a variety of manners. In some embodiments, and as representatively illustrated in FIG. 1, the contacting surface may be driven in a rotary manner, with the contacting surface coupled to a motor 117 by way of an axle 119. In some embodiments the contacting surface may be driven by a linear motion device, with the direction of motion for example parallel to the surface of the electrically insulating material or perpendicular to the surface. In some such embodiments the linear movement may be oscillatory, for example driven by a motor, with the motor having periodically timed reversals of direction or with the motor coupled to the contacting surface by appropriate direction reversal linkages. In some such embodiments the linear movement may be applied through circulation of a belt or band, with the belt or band serving as or carrying the contacting surface. In some embodiments the contacting surface may be driven by hand operated devices, and in some embodiments be driven by hand driven devices.

In operation, the changing contact between the contacting surface and the electrically insulating material results in electron accumulation, or negative charging, of the electrically insulating material. In embodiments in which the electrically insulating material is a membrane forming a portion of the wall of the housing, the membrane becomes negatively charged. In embodiments in which the electrically insulating material is an exterior cover for a section of the housing, for example a metal section, electrically insulated from other portions of the housing, forming the second wall, the metal becomes negatively charged. The electrons providing the negative charge may travel to and strike an electron target within the housing.

In the embodiment of FIG. 1, the electron target is a metal on an interior surface of a window 121 of the housing. The metal, which may be gold, may be deposited on the window by sputtering, for example. The window is substantially transparent to x-rays, and may be formed for example of beryllium. As illustrated in FIG. 1, the window is on a wall of the housing opposite the wall having the electrically insulating material forming an exterior portion. As the electrons strike the metal, some x-rays may be generated. The x-rays may exit the housing through the beryllium window, with the device therefore serving as an x-ray generator with x-ray emission or transmission capabilities.

Figure 2:
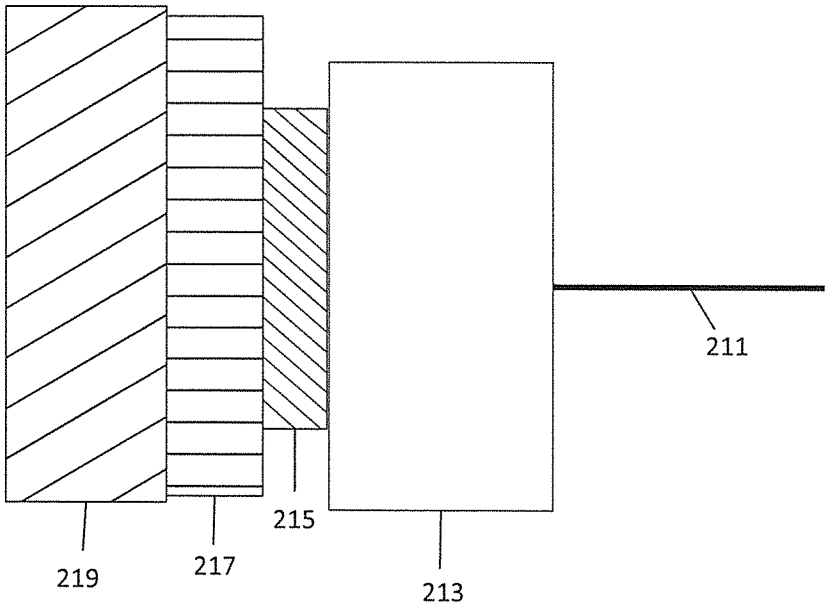
FIG. 2 illustrates a cross section of a portion of a wall of a housing in contact with a contact surface in accordance with aspects of the invention.

FIG. 2 illustrates a contacting surface 215 in contact with an electrically insulating material 217, for example as in some embodiments of the device of FIG. 1. In FIG. 2, an axle 211 drives a base 213. The base may be wood in some embodiments. The contacting surface 215 is fixed to the base, and therefore is driven along with the base. The contacting surface may be, for example, quartz. The contacting surface is in changing contact with the electrically insulating material, for example Kapton. The Kapton is fixed to, and provides an exterior surface for a metal 219. As the Kapton tribocharges due to the changing contact with the contacting surface, negative charge accumulates on a surface of the metal away from the Kapton surface, namely on a surface of the metal exposed to an interior of a housing.

Figure 3:
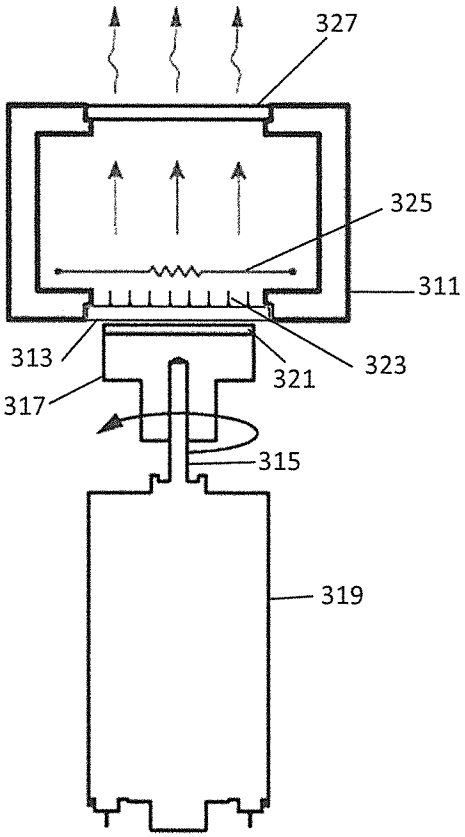
FIG. 3 illustrates aspects of a further x-ray emission device in accordance with aspects of the invention.

FIG. 3 illustrates aspects of a further x-ray emission device in accordance with aspects of the invention. The device of FIG. 3, like the device of FIG. 1, includes a housing 311 configured to maintain a low fluid pressure environment. The housing includes a portion of one wall including a membrane 313 of a dielectric material, with in some embodiments the dielectric material covering an exterior of a metal, electrically insulated from the rest of the housing, forming the rest of the portion of the one wall. An axle 315 drives a base 317, with the base having fixed to it a contacting material 321 in changing contact with the dielectric of the housing. The axle, as illustrated in FIG. 3, is driven by a motor 319.

Interior to the membrane, and interior to the metal underlying the membrane, if present, are field emitting tips 323. The field emitting tips may be, for example, sharp metal tips or carbon nanotubes. In some embodiments the field emitting tips extend from metal pieces interior to the membrane. In some embodiments there are a plurality of such metal pieces, which in some embodiments are electrically insulated from each other. In some embodiments one field emitting tip extends from each metal piece, in some embodiments one or more field emitting tips extend from each metal piece, and in some embodiments a plurality of field emitting tips extend from each metal piece. Further, in some embodiments a conductive mesh may be placed over the field emitting tips, with a relatively low voltage, less than 1000 V in some embodiments, applied to the conductive mesh to assist in preventing electrical discharge from the field emitting tips; with control of the applied voltage serving to control the electron emission from the tips. A heatable filament 325, for example of tungsten or Lanthanum Hexoboride, or alternatively a cathode such as a Barium Oxide cathode, is also interior of the housing, preferably proximate the field emitting tips. The heatable filament may be coupled to an energy source, for example a battery, through ports (not shown) in the housing. The heatable filament provides an electron source, for example that can be under controlled power from an external power supply.

Another wall of the housing, shown opposite the wall with the dielectric in FIG. 3, contains a window 327. The window itself is substantially transparent to x-rays, being formed of for example Beryllium. In the embodiment of FIG. 3, however, an interior surface of the window is covered with a metal, for example gold, forming an electron target, Operation of the device of FIG. 3 results in negative charging of the membrane, with electrons from the membrane and the filament traveling to and striking the electron target on the surface of the window. X-rays generated from this process travel through the window, with the device therefore being an x-ray emission source.

Figure 4:
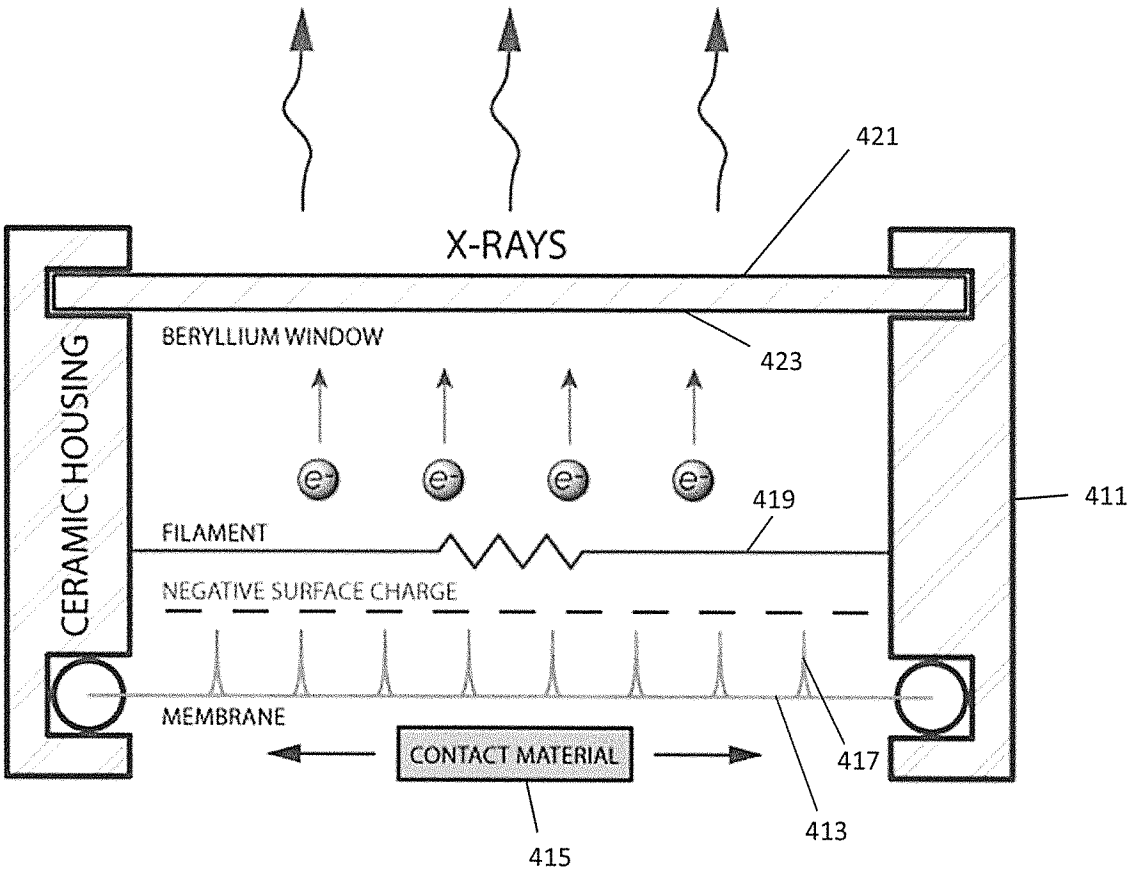
FIG. 4 illustrates aspects of a further x-ray emission device in accordance with aspects of the invention.

FIG. 4 illustrates aspects, in semi-cross-sectional view, of a further x-ray emission device in accordance with aspects of the invention. The device of FIG. 4 is similar to the device of FIG. 3, with a housing 411 providing for maintenance of a low fluid pressure environment, a Beryllium window 421 on one side of the housing, and a membrane 413 forming a portion of an opposing wall of the housing. A contacting material 415, higher in a triboelectric series than the membrane, is in sliding linear contact with the membrane, resulting in tribocharging of the membrane. Field emitting tips 417 extend from the membrane towards the interior of the housing, with a filament 419, for example heatable, between the window and tips of the field emitting tips, and preferably closer to or proximate the field emitting tips. Negative tribocharging of the membrane allows for accumulation of negative charge at tips of the field emitting tips, substantially providing a negative surface charge about the tips, and allowing the tips to serve as a cathode. A metallic interior surface 423 on the window serves as an anode, receiving electrons from filament. As electrons strike the metallic interior surface, which also acts as an electron target, x-rays are generated and transmitted through the window.

Figure 5:
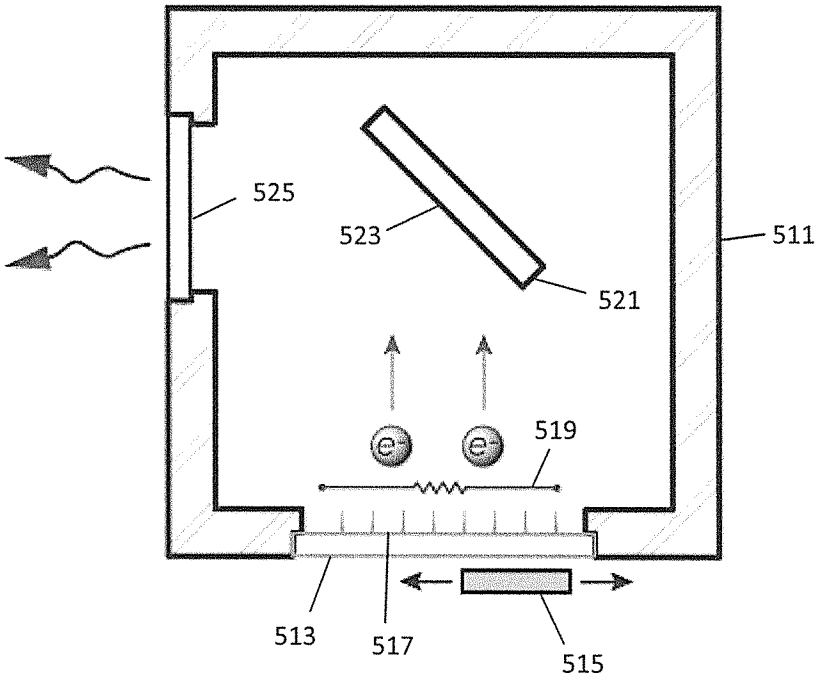
FIG. 5 illustrates aspects of a further x-ray emission device in accordance with aspects of the invention.

FIG. 5 illustrates aspects of a further x-ray emission device in accordance with aspects of the invention. The device of FIG. 5 is similar to that of FIG. 4, but differs in that the window does not have a metallic coating. Instead, an electron target is in the interior of the housing, and not in contact with the window.

In the device of FIG. 5, a housing has a window 525 on one wall, with the window substantially transparent to x-rays. A membrane, for example of Kapton, forms a portion of another wall, with the other wall not opposite the wall including the window. A contacting material 515 is in sliding changing contact with the membrane, with the contacting material higher in a tribocharging series than the membrane. Field emitting tips are immediately interior to the membrane, with a filament 519 interior to the field emitting tips.

A solid electron target 521, for example of a metal, is in the interior of the housing. The electron target includes a surface 523 having a line of sight with both the filament/field emitting tips/membrane and the window. As the device is operated, electrons from the filament strike the electron target, generating x-rays, some of which exit through the window. Advantageously, in some embodiments the electron target may be rotated such that the surface 523 may receive fewer electrons, or rotated so as to emit fewer x-rays towards the window, allowing for increased control of x-ray flux through the window. Similarly, or additionally, in some embodiments the electron target may be moved closer to or farther from the window, also allowing for increased control of x-ray flux through the window. The distance from the membrane to the target can also be varied, in some embodiments, to change the maximum energy of the striking electrons as a means to control the output x-ray energy. The material of the target can be chosen to provide a particular x-ray spectrum, with for example the characteristic x-ray lines of a material such as Molybdenum. Further, in some embodiments the portion of the housing and the contacting surface, and the field emitting tips, may be instead or in addition be placed in reverse, with these items instead or in addition placed on an opposing side of the housing and the materials of the exterior of the portion of the housing and the contacting surface reversed. With the materials reversed, in operation a positive charge is generated, and with the positive charge attracting electrons from the filament to that opposing side of the housing, with in some embodiments the electron target in the path of such electrons. In some embodiments, however, the electron target may be elsewhere, for example on an interior surface of the window, with what may be considered back scattered electrons generating x-rays in the electron target, with x-rays emitted through the window.

Figure 6:
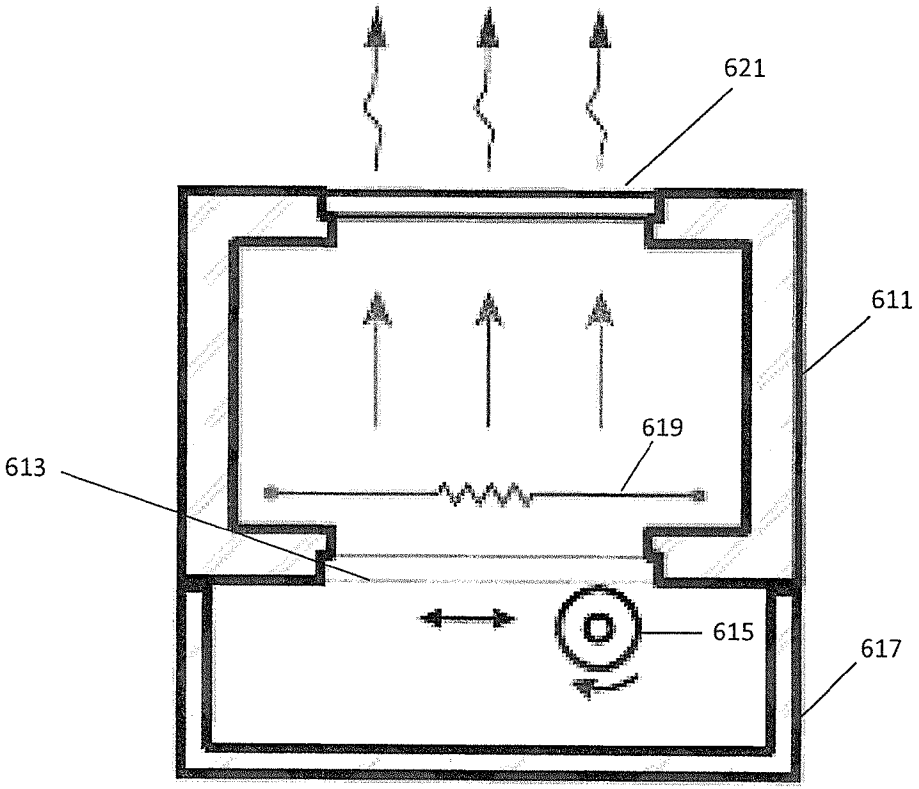
FIG. 6 illustrates aspects of a further x-ray emission device in accordance with aspects of the invention.

FIG. 6 illustrates aspects of a further x-ray emission device in accordance with aspects of the invention. In the embodiment of FIG. 6, a housing 611 again is configured to maintain a low fluid pressure environment. The housing includes a window 621 substantially transparent to x-rays on one wall, with a membrane 613, possibly covering an electrically insulated metal, on a portion of an opposing wall. Interior to the housing is a filament 619 to provide an electron source.

The membrane is negatively tribocharged through rolling contact with a contacting material 615. Material of the membrane and the contacting material are selected such that tribocharging occurs through changing contact of surfaces of the two materials, with the membrane being negatively charged compared to the contacting material.

In the embodiment of FIG. 6, a secondary container contains the contacting material, with the membrane also forming a wall of the secondary container. The container may be an enclosed container, providing a controlled environment about the contacting material and an exterior (to the housing) surface of the membrane. Preferably the controlled environment is controlled so as to prevent electrical discharge exterior of the housing. In some embodiments the controlled environment is at a fluid pressure that reduces discharge, and in some embodiments the container contains a dielectric medium, for example sulfur hexafluoride, to assist in preventing discharge.

Figure 7:
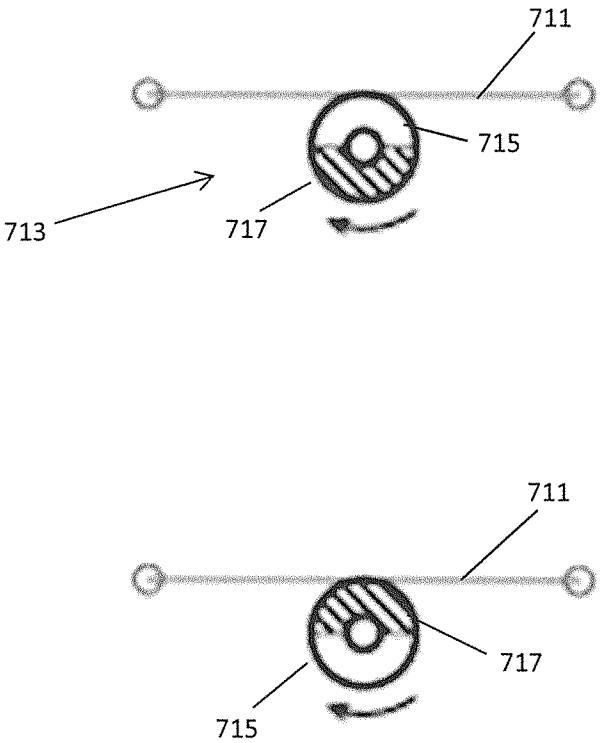
FIG. 7 illustrates aspects of the x-ray emission device of FIG. 6.

FIG. 7 illustrates an embodiment of a contacting roller 713, which may also slide, in contact with a membrane 711. The contacting roller includes a first portion 715 of a first dielectric material and a second portion 717 of a second different dielectric material with a lower dielectric constant. Each of the first dielectric material and the second dielectric material are exposed on the surface of the roller in different areas. As the roller rolls across the membrane, the first portion and the second portion alternate in contacting the membrane. This alternating contact results in variation of compensating charge, with accumulated negative charge on the membrane being ejected as the second dielectric material contacts the membrane.

Figure 8:
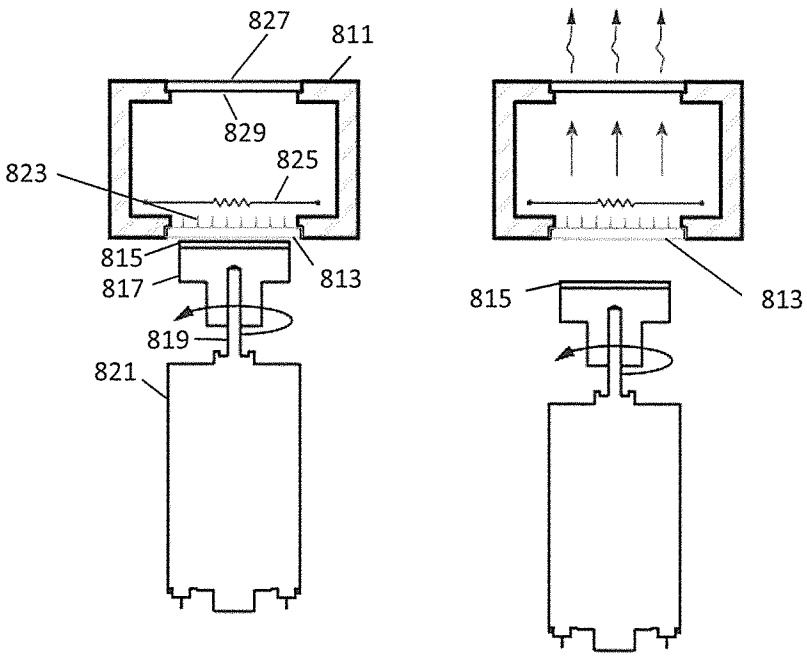
FIG. 8 illustrates a mode of operation of an x-ray generation device in accordance with aspects of the invention.

FIG. 8 illustrates a mode of operation of an x-ray transmission device in accordance with aspects of the invention. In FIG. 8 a housing 811 is configured to maintain a low fluid pressure environment. The housing includes a window 827 on one side of the housing, with the window of a material substantially transparent to x-rays. An electron target is on an interior surface of the window. A membrane 813 forms a portion of an opposing wall of the housing, preferably with field emitting tips 823 interior to the membrane, and a heatable filament interior to the field emitting tips. The membrane is in changing contact with a contacting material 815. Material of the membrane and the contact material are selected such that the changing contact results in negative tribocharging of the membrane.

The contacting material is mounted to a base 817 on a drive system. As shown in the embodiment of FIG. 8, the drive system includes an axle 819 driven by a motor 821, with the axle rotating the base 817. In other embodiments the contacting material may be otherwise driven.

As illustrated in FIG. 8, the contacting material may be withdrawn from contact with the membrane. Once the contacting material is withdrawn from such contact, accumulated negative charge is ejected from an interior surface of the membrane, resulting in electrons flowing from the filament to the electron target, generating x-rays which pass through the window.

Although the invention has been discussed with respect to various embodiments, it should be recognized that the invention comprises the novel and non-obvious claims supported by this disclosure.

What is claimed is:

1. An x-ray emission device, comprising:

a housing configured to maintain a low fluid pressure environment, the housing having a a first wall with a window substantially transparent to x-rays and a second wall having a portion comprising an exterior surface of the housing comprising an electrically insulating material;

an electron target within the housing;

an electrically chargeable material within the housing; and a contact material for frictionally contacting the electrically insulating material of the exterior surface of the housing, the contact material comprising a material such that frictional contact with the electrically insulating material generates a charge imbalance.

2. The x-ray emission device of claim 1, wherein the portion of the second wall comprising the electrically insulating material further comprises a metal interior to and in contact with the electrically insulating material, the metal electrically insulated from other portions of the housing.

3. The x-ray emission device of claim 1, wherein the electron target is metal on an interior surface of the window substantially transparent to x-rays.

4. The x-ray emission device of claim 3, wherein the metal is gold sputtered onto to the window substantially transparent to x-rays.

5. The x-ray emission device of claim 1, wherein the electrically insulating material comprises a dielectric.

6. The x-ray emission device of claim 1, wherein the electrically insulating material comprises a membrane.

7. The x-ray emission device of claim 1 wherein the electrically chargeable material is a mesh.

8. The x-ray emission device of claim 1, wherein the electron target comprises a metal.

9. The x-ray emission device of claim 1, wherein the electron target comprises a ceramic compound.

10. The x-ray emission device of claim 1, wherein the electron target comprises a rare earth compound.

* * * * *